US007556319B1

(12) United States Patent
Boos et al.

(10) Patent No.: US 7,556,319 B1
(45) Date of Patent: Jul. 7, 2009

(54) APPARATUS FOR RESURFACING CONCRETE

(75) Inventors: Fredrick A. Boos, Temple Terrace, FL (US); Scott F. Boos, Tampa, FL (US)

(73) Assignee: Blasters Technologies, LLC, Tampa, FL (US)

( * ) Notice: Subject to any disclaimer, the term of this patent is extended or adjusted under 35 U.S.C. 154(b) by 92 days.

(21) Appl. No.: 11/688,623

(22) Filed: Mar. 20, 2007

(51) Int. Cl.
*E01C 23/12* (2006.01)

(52) U.S. Cl. ..... 299/17

(58) Field of Classification Search ..... 299/17
See application file for complete search history.

(56) References Cited

U.S. PATENT DOCUMENTS 919,105 A * 4/1909 Wischow ..... 299/71
3,779,403 A * 12/1973 Young ..... 414/279
4,356,890 A * 11/1982 Smart ..... 52/745.2
4,854,770 A * 8/1989 Puchala et al. ..... 404/75
6,857,706 B2 * 2/2005 Hames et al. ..... 299/18

* cited by examiner

*Primary Examiner*—John Kreck
(74) *Attorney, Agent, or Firm*—Ronald E. Smith; Smith & Hopen, P.A.

(57) ABSTRACT

Concrete on a vertical wall is removed for resurfacing in the substantial absence of microfracturing by a crawler apparatus that is lowered from the top of the wall to the bottom by remote control. The crawler is raised and lowered by cables that are reeled in or out depending upon the direction of rotation of the output shaft of a motor. A rotating nozzle blasts a focused stream of very high-pressure water against the concrete to be removed. The nozzle is carried back and forth along the breadth of the crawler as the crawler descends the face of the concrete wall so that a vertical strip of concrete substantially equal in width to the width of the crawler is removed. The crawler is then returned to the top of the wall and moved laterally to begin removal of the next vertical strip of concrete.

7 Claims, 3 Drawing Sheets

APPARATUS FOR RESURFACING CONCRETE

BACKGROUND OF THE INVENTION

1. Field of Invention

This invention relates to the re-surfacing of concrete. More particularly, it relates to an apparatus having utility in resurfacing concrete found in vertical walls such as cooling towers.

2. Description of the Prior Art

Cooling towers are huge structures having concrete walls of hyperbolic shape. The shape creates an upwardly flowing draft of air that cools heated cooling water from steam condenser boxes that convert hot steam back into condensate water that is re-heated and re-used as steam. The concrete walls require refinishing from time to time. The art currently requires the building of scaffolding that carries workers to the top of the tower and which gradually lowers the workers as they remove the concrete with jack hammers and other equipment.

There are a number of drawbacks to the known concrete-removal procedure. Scaffolding is inherently dangerous, for example. Moreover, the work is labor intensive and the time required to remove the concrete is substantial. Jack hammers inherently leave micro fractured concrete behind, creating a very poor surface to which repair concrete may adhere. This leads to premature failure of the repaired concrete.

There is a need for a procedure that does not require workers to stand on an elevated scaffold. There is also a need for a procedure that performs the work in substantially less time and which does not create poor concrete bonding surfaces.

However, in view of the art considered as a whole at the time the invention was made, it was not obvious to those of ordinary skill in this art how the concrete-removing procedure could be improved. The non-obviousness of the invention disclosed below is established by the many years that the art has employed workers on scaffolds to do the job.

SUMMARY OF INVENTION

The long-standing but heretofore unfulfilled need for an improved concrete-removal procedure is now met by a new, useful, and non-obvious invention. The novel structure provides an apparatus for removing concrete from a substantially vertical wall. It includes a crawler assembly having a frame of predetermined breadth. A nozzle housing is carried by the frame. A reciprocating means causes the nozzle housing to follow a path of travel that reciprocates between a first end of the frame and a second end of the frame. A nozzle is carried by the nozzle housing and is adapted to emit water under high pressure. The water impinges upon and removes concrete from the substantially vertical wall for refurbishing purposes. A lifting and lowering means is provided for lifting the crawler from a bottom of the vertical wall to a top of the vertical wall and for lowering the crawler from a top of the vertical wall to a bottom of the vertical wall. A vertical strip of concrete is thereby removed from the vertical wall by the water under high pressure as the nozzle housing reciprocates and rotates as the crawler is lowered from a top of the vertical wall to a bottom of the vertical wall. The vertical strip has a width substantially equal to the width of the frame.

A first support plate and a second support plate are secured to the substantially vertical wall at an upper end thereof in laterally spaced apart relation to one another. A first pulley is rotatably mounted to the first support plate and a second pulley is rotatably mounted to the second support plate.

A hydraulic motor is connected in driving relation to a winch having two winch spools connected to one another by a common shaft to provide conjoint movement. A first elongate cable is wrapped about a first pulley and has a proximal end disposed in coiled relation to a first winch spool and a distal end secured to the frame adjacent a first end thereof. A second elongate cable is wrapped about a second pulley and has a proximal end disposed in coiled relation to a second winch spool and a distal end secured to the frame adjacent a second end thereof. Rotation of the two winch spools in a first direction lifts the crawler from the bottom of the vertical wall to the top thereof and rotation of said spools in a second direction opposite to the first direction lowers the crawler from the top of the vertical wall to the bottom thereof.

The frame has a substantially rectangular configuration and includes a laterally disposed top member, a laterally disposed bottom member parallel to the top member, and a longitudinally disposed first side member interconnecting respective first ends of the top and bottom members. The frame further includes a longitudinally disposed second side member parallel to the first side member, said second side member interconnecting respective second ends of the top and bottom members. A first set of wheels adapted to rotatably engage the vertical wall is secured to the top member at the first end thereof. A second set of wheels adapted to rotatably engage the vertical wall is secured to the top member at the second end thereof. A third set of wheels adapted to rotatably engage the vertical wall is secured to the bottom member at the first end thereof, and a fourth set of wheels adapted to rotatably engage the vertical wall is secured to the bottom member at the second end thereof.

In an embodiment adapted for use with cooling towers having at least a first and a second vertically extending groove formed in the vertical wall, where the first and second grooves are laterally spaced apart from one another by a distance substantially equal to a distance that separates the first and third set of wheels from one another and the second and fourth set of wheels from one another, each of the sets of wheels includes at least two wheels. One large diameter wheel of the at least two wheels in each of the four sets has a diameter larger than other wheels in each set. The large diameter wheel of each set is adapted to travel in the vertically-extending groove formed in the vertical wall. A first jack assembly adapted to push the first end of the frame away from the vertical wall is secured to a first end of the frame. A second jack assembly adapted to push the second end of the frame away from the vertical wall is secured to a second end of the frame. Said first and second jack assemblies lift each large diameter wheel of said four sets of wheels from its associated groove.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
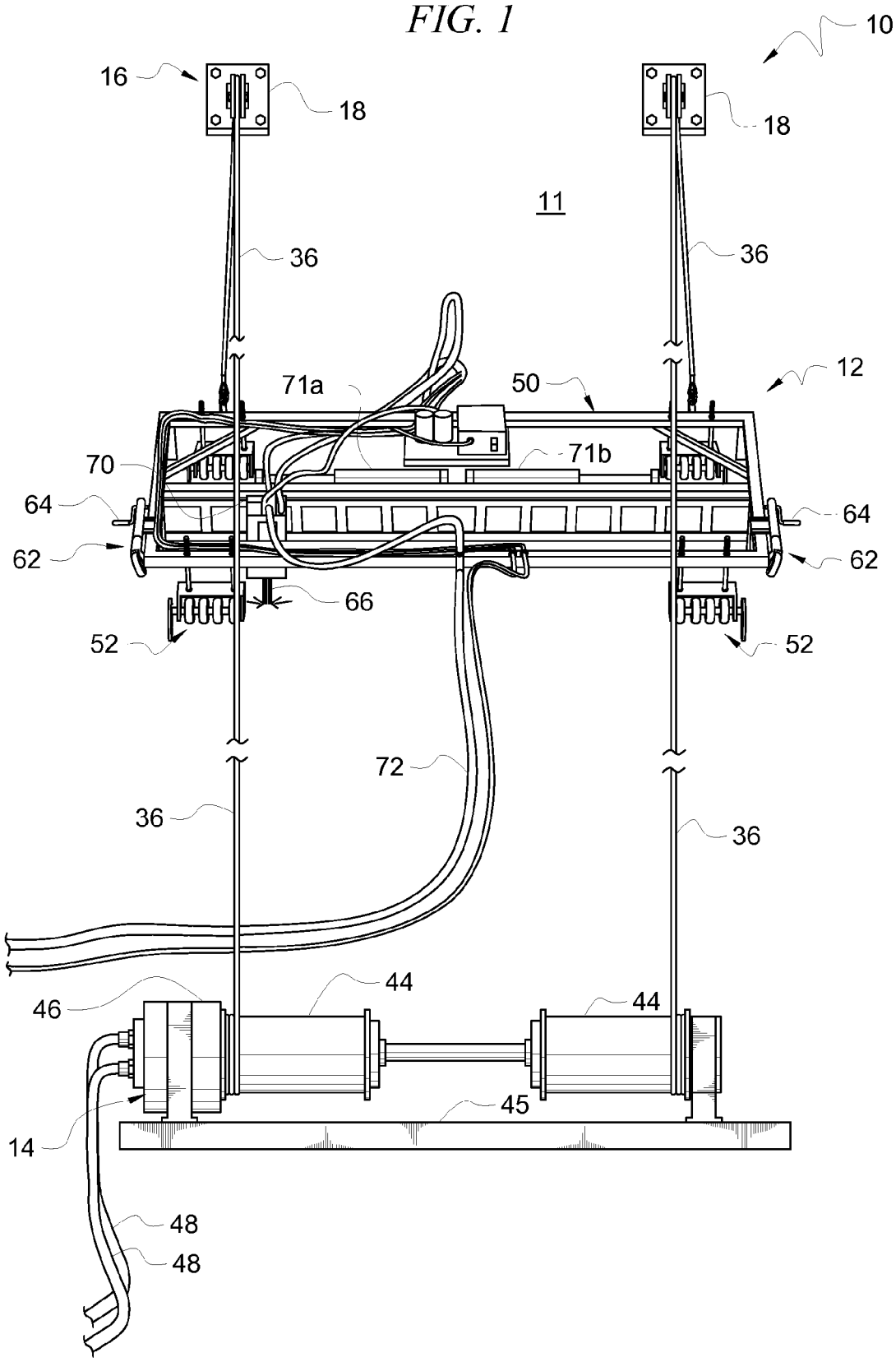
FIG. 1 is a front elevational view depicting an illustrative embodiment of the novel apparatus.

Referring now to FIG. 1, it will there be seen that an illustrative embodiment of the invention is denoted as a whole by the reference numeral 10.

Apparatus 10 includes crawler 12 that carries a high-pressure water nozzle that performs the concrete removal preparatory to re-surfacing. The motor and common shaft winch system that control crawler 12 are denoted 14 as a whole. The support assembly that is bolted to concrete wall 11 of a cooling tower or other substantially vertical wall is denoted 16 as a whole.

Figure 2:
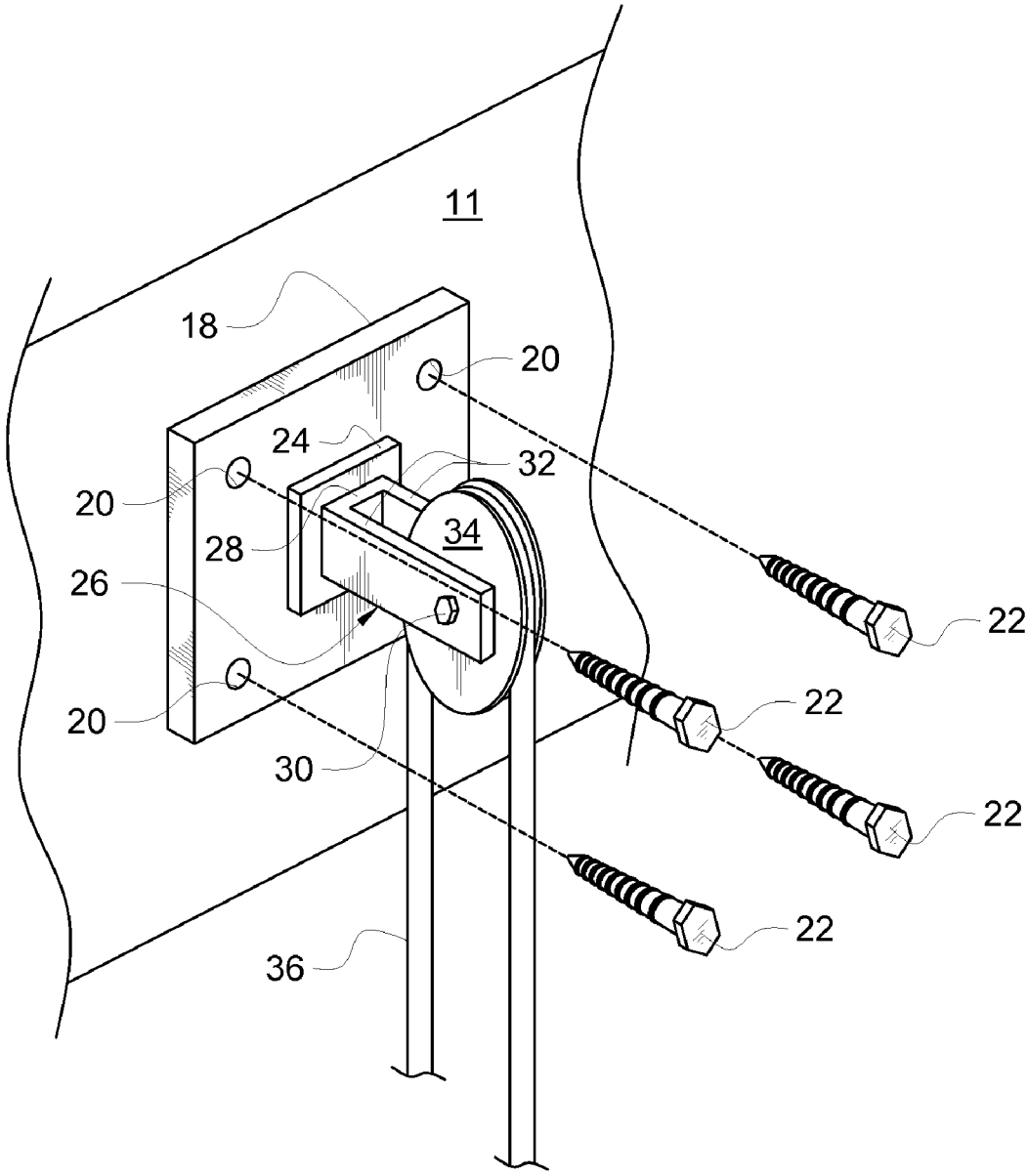
FIG. 2 is an exploded, perspective view of the mounting plates that support the weight of the crawler and the other parts of the novel apparatus.

As best understood in connection with FIGS. 1 and 2, support assembly 16 includes flat plates, collectively denoted 18, having apertures, collectively denoted 20, formed therein at the corners thereof. Each flat plate 18 overlies the concrete surface or wall 11 of a cooling tower or other generally vertically disposed wall made of concrete. Each flat plate 18 is secured to concrete surface 11 by a plurality of bolts, collectively denoted 22, each of which extends through an associated aperture 20 to engage concrete wall 11 and secure its associated flat plate 18 to said concrete wall 11. Mounting plate 24 is secured to each flat plate 18, centrally thereof, Clevis 26 has a flat base 28 secured to mounting plate 24 and a clevis pin 30 extends between transversely opposed arms 32 of the clevis and captures pulley 34. Clevis pin 30 serves as an axle for pulley 34 so that said pulley is free to rotate.

As best understood in connection with FIG. 1, cables 36, 36 respectively wrap about their associated pulley 34, 34. As best depicted in FIG. 2, the angle of wrap is one hundred eighty degrees (180°). A plurality of support assemblies 16 is secured to the cooling tower or other concrete structure having a vertical concrete surface in need of resurfacing, with each support assembly 16 being equidistantly spaced from its contiguous assemblies and with each assembly 16 being at, above, or near the top of the concrete surface to be refinished.

Figure 3:
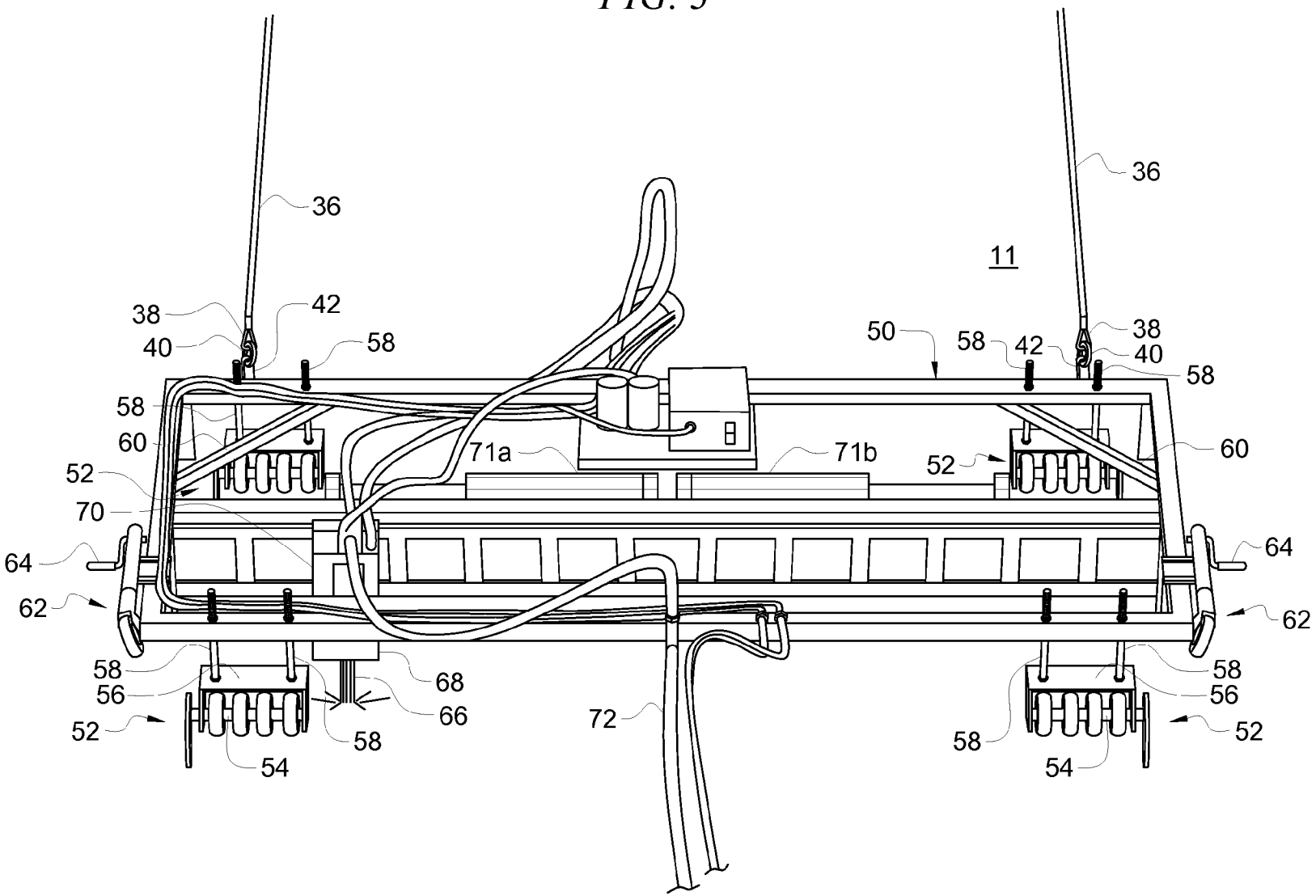
FIG. 3 is a front elevational view of the crawler.

As best depicted in FIG. 3, the distal end of each cable 36 has a loop 38 formed therein, and each loop engages a ring 40. Each ring captures an apertured lug 42 and each apertured lug 42 is secured to crawler 12.

As best understood in connection with FIG. 1, the proximal end of each cable 36 is disposed in coiled relation about a reel or winch, of which there are two interconnected spools 44, 44, both of which are mounted to platform 45. Each winch spool 44 rotates conjointly with an output shaft of motor 46 so that a cable 36 is reeled in when motor 46 operates in a first direction and is reeled out when said motor operates in a direction opposite to the first direction. Platform 45 is stationary during operation of hydraulic motor 46. Therefore, operating hydraulic motor 46 in a first direction reels in cable 36 and lifts crawler 12 and operating said motor in a second direction opposite to the first unreels cables 36 and lowers crawler 12.

Hydraulic supply hoses and electrical power conductors, collectively denoted 48, are connected to a conventional control box for motion control.

Cable 36 is initially reeled in to lift crawler 12 to an upper edge of a concrete wall to be re-surfaced, and nozzle housing 70 is then activated so that it begins its alternating left-to-right and right-to-left travel along the extent of frame 50. Crawler 12 is slowly lowered during such nozzle travel by slowly reeling out cables 36, 36, thereby slowly lowering crawler 12.

The structure of crawler 12 is best depicted in FIG. 3. Lugs 42 are secured to rectangular frame 50 as aforesaid and said frame is spaced apart from the vertical concrete surface by four (4) sets of wheels, collectively denoted 52. In this illustrative embodiment, each set of wheels includes five (5) wheels disposed in lateral relation to one another, equidistantly spaced apart along the extent of a common axle. The number of wheels may change depending upon what the requirements are of a particular application. In this cooling tower application, each set of wheels includes four (4) rubber or hard plastic wheels, collectively denoted 52*a*, having a common size that rotatably engage the vertical surface of a cooling tower and one (1) outboard steel wheel 52*b* that has a diameter that exceeds the common diameter of the four (4) rubber or hard plastic wheels.

Each of the outboard wheels is preferably formed of steel and is larger in diameter than the other four (4) wheels in this particular embodiment but the wheels may have a common diameter in many applications. The depicted embodiment is adapted for use in treating the concrete surface of a power plant cooling tower. Such cooling towers typically have a plurality of vertically-extending raised ridges formed on them that extend from the top of the tower to the bottom, and said raided ridges converge toward one another from bottom to top, i.e., diverge from one another from top to bottom. Steel outboard wheels 52*b* keep crawler 12 positioned between contiguous ridges. The width of crawler 12 is dictated by the lateral distance between the ridges when crawler 12 is built for treatment of said cooling towers. Where the concrete wall being blasted with high pressure water is not a cooling tower wall, the width of crawler 12 may be changed to any convenient breadth and wheels 52 may have a common diameter. Each enlarged wheel 52*b* in this depicted embodiment is a hard wheel and is adapted to ride between the cooling tower vertical ridges. Wheels 52*a* of smaller diameter rollingly engage the concrete wall contiguous to the ridge. Thus it is understood that each large steel wheel 52*b* serves as a guide means that ensures that crawler 12 remains between contiguous ridges as said crawler is lowered down or raised up the face of the concrete wall.

The opposite ends of each axle 54 engage transversely opposed arms of clevis 56 so that the wheels are free to rotate. Elongate adjustment screws, collectively denoted 58, adjustably interconnect their associated clevis 56 to frame 50. This enables frame 50 to be positioned a preselected distance from concrete wall 11. A pair of braces 60 is positioned at opposite ends of frame 50 to enhance the structural integrity of said frame.

Lifting wheels, collectively denoted 62, have a caster wheel construction as illustrated. Each lifting wheel assembly includes a hand crank 64. When a vertical strip of wall has been treated, an operator in a man-lift cranks hand crank 64 and said cranking jacks the associated lifting wheel assembly so the caster wheels bear against the concrete wall and lift crawler 12 and wheels 52*a*, 52*b* away from said wall. The lifting distance is sufficient to withdraw large wheel 52*b* of each set of wheels 52 from its associated vertical ridge so that crawler 12 may be moved to the left or right to begin another trip up or down the face of the wall.

More particularly, the movement of crawler 12 to the left or right is accomplished by providing a pair of relatively short, fixed length cables, not depicted, that respectively have a first end secured to an associated flat plate 18 and a second end releasably engaged to frame 50. The second ends of said short cables are detached from frame 50 when apparatus 10 is traveling down the face of the concrete wall being treated. When crawler 12 reaches its lowermost position, i.e., when a first vertical strip of the wall has been treated (said vertical strip being substantially the width of the lateral travel of nozzle housing 70), crawler 12 is drawn up to the top of the wall as the first step in re-positioning it to the left or right so that a second vertical strip contiguous to the first may be treated. When so lifted, frame 50 is spaced from support plates 18, 18 by a distance less than the respective lengths of the short cables. The lower ends of the short cables are therefore easily attached to frame 50 by means of lugs similar to lugs 42 and crawler 12 is lowered until the short support cables support the weight of crawler 12 and motor assembly 14. This removes the weight from cables 36. A worker in a man-lift then lifts each cable 36 from its associated pulley 34 and moves each cable 36 to an associated pulley of a contiguous second set of pulleys that are rotatably supported by a second pair of support plates 18. A plurality of pairs of support plates 18, 18 are secured to the wall to be treated along an upper end thereof as aforesaid, with each pair of support plates being positioned so that when crawler 12 is lowered with respect thereto, a vertical strip of the wall is treated and each vertical strip is contiguous to another vertical strip. Where the wall to be treated is the wall of a cooling tower or other structure having annular walls, the entire structure is encircled by cooperatively positioned pairs of support plates 18, 18 so that the crawler may be moved from one pair of support plates to another pair of contiguous support plates until the entire structure has been circumnavigated.

Although the invention is not limited to cooling towers, it should be observed that wheels 52 may have a common diameter when a surface other than a cooling tower surface is being treated, unless said surface is also provided with raised ridges in the manner of a cooling tower.

A highly focused stream of high-pressure water is denoted 66 in FIG. 3. Water 66 removes old concrete so that new concrete may be applied. Water 66 is emitted by nozzle 68 that forms a part of nozzle housing 70. Hose 72 supplies high-pressure water from a remote source to said nozzle housing 70. Nozzle housing 70 is adapted to travel laterally, i.e., from left to right and from right to left in alternating sequence as crawler 12 is slowly lowered down the face of concrete wall 11 by unreeling cable 36, 36. A hydraulic motor propels the nozzle housing. A pinion gear, not depicted, is secured to the output shaft of the hydraulic motor for conjoint rotation therewith. The pinion gear meshingly engages a stationary elongate rack gear so that nozzle housing 70 moves along the extent of the rack gear in a first direction as the pinion gear rotates in a first direction.

A first limit switch is positioned at a first end of the rack gear so that when nozzle housing 70 contacts said first limit switch, said first limit switch generates and sends a signal to the hydraulic motor that reverses the direction of rotation of the output shaft and hence of the pinion gear, thereby causing the nozzle housing to travel in a second direction opposite to said first direction. A second limit switch is positioned at a second, opposite end of the rack gear so that when nozzle housing 70 contacts said second limit switch, said second limit switch generates and sends a signal to the hydraulic motor that reverses the direction of rotation of the output shaft and hence of the pinion gear so that nozzle housing 70 travels in said first direction, and said alternating or reciprocating travel continues as frame 50 is lowered down the face of the concrete surface undergoing treatment.

The hydraulic cylinders that provide the means for such traverse adjustment are denoted 71*a*, 71*b* in FIGS. 1 and 3.

A worker standing on the ground remotely controls the novel apparatus. This eliminates the prior art hazard of one or more workers positioned on a scaffold at dangerous heights.

When crawler 12 reaches the bottom of a concrete wall, it is returned to the top edge of said wall, moved to the left or right one frame length by following the procedure disclosed above, and the process is repeated as needed. The crawler is much safer to use than a manned apparatus, and it performs the concrete removal work much faster and with a high level of consistency.

The novel structure efficiently removes unsound concrete without introducing micro fractures, thereby providing high quality surface preparation so that the repair of the concrete surface has substantially enhanced longevity relative to the repair methods heretofore known.

The rotation speed of the nozzle is critical, as is the nozzle stand off distance, the nozzle attack angle, its transverse speed, and its vertical (up and down) speed. Optimizing these critical parameters creates the desired high quality surface preparation. While these parameters may vary from job to job, a typical nozzle rotation speed is two hundred revolutions per minute (200 rpm), a typical nozzle standoff is two to three inches (2-3"), a typical nozzle attack angle is twelve degrees (12°), a typical transverse speed is eight inches per second (8"/sec), and a typical up and down speed is three inches per minute (3"/min).

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween. Now that the invention has been described,

What is claimed is:

1. An apparatus for removing concrete from a substantially vertical wall, comprising:

a crawler assembly;

said crawler assembly including a frame of predetermined breadth;

a nozzle housing carried by said frame;

reciprocating means for causing said nozzle housing to follow a path of travel that reciprocates between a first end of said frame and a second end of said frame;

a nozzle carried by said nozzle housing, said nozzle adapted to emit water under high pressure, said water impinging upon and removing said concrete from said substantially vertical wall;

lifting and lowering means for lifting said crawler from a bottom of said vertical wall to a top of said vertical wall and for lowering said crawler from a top of said vertical wall to a bottom of said vertical wall;

a first support plate and a second support plate secured to said substantially vertical wall at an upper end thereof in laterally spaced apart relation to one another;

a first pulley rotatably mounted to said first support plate;

a second pulley rotatably mounted to said second support plate;

a winch system including a synchronized double winch apparatus mounted on a common drive shaft;

a motor connected in driving relation to said winch system;

a first elongate cable wrapped about said first pulley, said first elongate cable having a proximal end disposed in coiled relation to a first winch of said double winch apparatus and a distal end secured to said frame adjacent a first end thereof;

a second elongated cable wrapped about said second pulley, said second elongate cable having a proximal end disposed in coiled relation to a second winch of said double winch apparatus and a distal end secured to said frame adjacent a second end thereof;

whereby a vertical strip of concrete is removed from said substantially vertical wall by said water under high pressure as said nozzle housing reciprocates as said crawler is lowered from a top of said substantially vertical wall to a bottom of said substantially vertical wall, said vertical strip having a width substantially equal to the width of said frame; and whereby rotation of said winch system in a first direction lifts said crawler from said bottom of said substantially vertical wall to said top of said substantially vertical wall and rotation of said winch system in a second direction opposite to said first direction lowers said crawler from said top of said substantially vertical wall to said bottom of said substantially vertical wall.

2. The apparatus of claim 1, further comprising:

said frame having a substantially rectangular configuration and including a laterally disposed top member, a laterally disposed bottom member parallel to said top member, a longitudinally disposed first side member interconnecting respective first ends of said top and bottom members, and a longitudinally disposed second side member parallel to said first side member, said second side member interconnecting respective second ends of said top and bottom members;

a first set of wheels secured to said top member at said first end thereof, said first set of wheels adapted to rotatably engage said substantially vertical wall;

a second set of wheels secured to said top member at said second end thereof, said second set of wheels adapted to rotatably engage said substantially vertical wall;

a third set of wheels secured to said bottom member at said first end thereof, said third set of wheels adapted to rotatably engage said substantially vertical wall; and a fourth set of wheels secured to said bottom member at said second end thereof, said fourth set of wheels adapted to rotatably engage said substantially vertical wall.

3. The apparatus of claim 1, further comprising:

each of said two sets of wheels including at least one large outside wheel;

said at least one large wheel being adapted to control travel of said apparatus by following the vertically-extending ridges formed in said substantially vertical wall.

4. The apparatus of claim 3, further comprising:

at least a first and a second vertically extending ridge formed in said substantially vertical wall;

said first and second ridges being laterally spaced apart from one another by a distance substantially equal to a distance that separates said first and third set of wheels from one another and said second and fourth set of wheels from one another;

a first jack assembly secured to a first end of said frame, said first jack assembly adapted to push said first end of said frame away from said substantially vertical wall;

a second jack assembly secured to a second end of said frame, said second jack assembly adapted to push said second end of said frame away from said substantially vertical wall;

whereby each large diameter steel wheel of said four sets of wheels is lifted from its associated ridge by said first and second jack assemblies.

5. An apparatus for removing concrete from a substantially vertical wall, comprising:

a crawler assembly;

said crawler assembly including a frame of predetermined breadth;

a nozzle housing carried by said frame;

reciprocating means for causing said nozzle housing to follow a path of travel that reciprocates between a first end of said frame and a second end of said frame;

a nozzle carried by said nozzle housing, said nozzle adapted to emit water under high pressure, said water impinging upon and removing said concrete from said substantially vertical wall;

lifting and lowering means for lifting said crawler from a bottom of said substantially vertical wall to a top of said substantially vertical wall and for lowering said crawler from a top of said vertical wall to a bottom of said substantially vertical wall;

a first support plate and a second support plate secured to said substantially vertical wall at an upper end thereof in laterally spaced apart relation to one another;

a first pulley rotatably mounted to said first support plate;

a second pulley rotatably mounted to said second support plate;

a winch system including a synchronized double winch apparatus mounted on a common drive shaft;

a motor connected in driving relation to said winch system;

a first elongate cable wrapped about said first pulley, said first elongate cable having a proximal end disposed in coiled relation to a first winch of said double winch apparatus and a distal end secured to said frame adjacent a first end thereof;

a second elongate cable wrapped about said second pulley, said second elongate cable having a proximal end disposed in coiled relation to a second winch of said double winch apparatus and a distal end secured to said frame adjacent a second end thereof;

said frame having a substantially rectangular configuration and including a laterally disposed top member, a laterally disposed bottom member parallel to said top member, a longitudinally disposed first side member interconnecting respective first ends of said top and bottom members, and a longitudinally disposed second side member parallel to said first side member, said second side member interconnecting respective second ends of said top and bottom members;

a first set of wheels secured to said top member at said first end thereof, said first set of wheels adapted to rotatably engage said substantially vertical wall;

a second set of wheels secured to said top member at said second end thereof, said second set of wheels adapted to rotatably engage said substantially vertical wall;

a third set of wheels secured to said bottom member at said first end thereof, said third set of wheels adapted to rotatably engage said substantially vertical wall; and a fourth set of wheels secured to said bottom member at said second end thereof, said fourth set of wheels adapted to rotatably engage said substantially vertical wall;

whereby a substantially vertical strip of concrete is removed from said substantially vertical wall by said water under high pressure as said nozzle housing reciprocates as said crawler is lowered from a top of said substantially vertical wall to a bottom of said substantially vertical wall, said substantially vertical strip having a width substantially equal to the width of said frame; and whereby rotation of said winch system in a first direction lifts said crawler from said bottom of said substantially vertical wall to said top of said substantially vertical wall and rotation of said winch system in a second direction opposite to said first direction lowers said crawler from said top of said substantially vertical wall to said bottom of said substantially vertical wall.

6. The apparatus of claim 5, further comprising:

each of said two sets of wheels including at least one large outside wheel;

said at least one large wheel being adapted to control travel of said apparatus by following the vertically-extending ridges formed in said substantially vertical wall.

7. The apparatus of claim 6, further comprising:

at least a first and a second substantially vertically extending ridge formed in said substantially vertical wall;

said first and second ridges being laterally spaced apart from one another by a distance substantially equal to a distance that separates said first and third set of wheels from one another and said second and fourth set of wheels from one another;

a first jack assembly secured to a first end of said frame, said first jack assembly adapted to push said first end of said frame away from said substantially vertical wall;

a second jack assembly secured to a second end of said frame, said second jack assembly adapted to push said second end of said frame away from said substantially vertical wall;

whereby each large diameter steel wheel of said four sets of wheels is lifted from its associated ridge by said first and second jack assemblies.

* * * * *